US007712264B2

(12) United States Patent
Johnson et al.

(10) Patent No.: US 7,712,264 B2
(45) Date of Patent: May 11, 2010

(54) EXTENDABLE AERIAL SERVICE WIRE MAST

(75) Inventors: Carrie P. Johnson, Longwood, FL (US); Daniel M. Taylor, Deltona, FL (US)

(73) Assignee: AT&T Intellectual Property I, L.P., Reno, NV (US)

( * ) Notice: Subject to any disclaimer, the term of this patent is extended or adjusted under 35 U.S.C. 154(b) by 0 days.

(21) Appl. No.: 10/436,511

(22) Filed: May 13, 2003

(65) Prior Publication Data

US 2004/0226227 A1 Nov. 18, 2004

(51) Int. Cl.

| | |
|---|---|
| ***E04H 12/34*** | (2006.01) |
| ***E04H 12/20*** | (2006.01) |
| ***E04H 12/18*** | (2006.01) |
| ***E04C 3/00*** | (2006.01) |

(52) U.S. Cl. ..... 52/111; 52/118; 52/146; 52/844; 52/632

(58) Field of Classification Search ..... 52/111, 52/127.2, 726.4, 732.3, 736.1, 632, 11, 114, 52/118, 121, 123.1, 126.1, 126.2, 126.3, 52/834, 844, 745.17, 475.18; 248/49, 59, 248/70, 514, 237

See application file for complete search history.

(56) References Cited

U.S. PATENT DOCUMENTS

| | | | | | |
|---|---|---|---|---|---|
| 1,664,161 | A | * | 3/1928 | Considine | 248/539 |
| 2,040,010 | A | * | 5/1936 | McMahon | 52/127.2 |
| 2,391,536 | A | * | 12/1945 | Anderson et. al. | 52/111 |
| 2,625,580 | A | * | 1/1953 | Price | 174/81 |
| 2,628,796 | A | * | 2/1953 | Krizman | 248/515 |
| 2,687,863 | A | * | 8/1954 | Vogt et. al. | 248/515 |
| 2,708,493 | A | * | 5/1955 | Badertscher et. al. | 52/115 |
| 2,758,152 | A | * | 8/1956 | Smul | 174/153 R |
| 3,208,703 | A | * | 9/1965 | Arnold et al. | 248/514 |
| 3,266,775 | A | * | 8/1966 | Homer | 254/127 |
| 4,077,172 | A | * | 3/1978 | Johnston | 52/111 |
| 4,181,284 | A | * | 1/1980 | Seppelfrick | 248/514 |
| 5,044,584 | A | * | 9/1991 | Lin | 248/68.1 |
| 5,067,586 | A | * | 11/1991 | Myers | 182/45 |
| 5,082,037 | A | * | 1/1992 | Hammons et al. | 144/286.5 |
| 5,205,022 | A | * | 4/1993 | Norton | 24/277 |
| 5,241,977 | A | * | 9/1993 | Flores et al. | 135/88.06 |
| 5,274,888 | A | * | 1/1994 | Payne | 24/277 |
| 5,538,207 | A | * | 7/1996 | O'Connell et al. | 248/49 |
| 5,566,916 | A | * | 10/1996 | Bailey | 248/230.1 |
| 5,775,035 | A | * | 7/1998 | Papin | 52/100 |
| 5,954,305 | A | * | 9/1999 | Calabro | 248/219.4 |
| 2002/0130223 | A1 | * | 9/2002 | McDonald | 248/49 |

* cited by examiner

*Primary Examiner*—Richard E Chilcot, Jr.
*Assistant Examiner*—Elizabeth A Plummer
(74) *Attorney, Agent, or Firm*—Scott P. Zimmerman PLLC

(57) ABSTRACT

An apparatus for supporting an aerial service wire includes a mast capable of attachment to an aerial service wire. The mast may be extendable between at least a first position and a second position and connected to a clamp capable of attachment to a support structure. A method for supporting an aerial service wire includes attaching an extendable aerial service wire mast to a support structure, attaching an aerial wire to the extendable aerial service wire mast, and adjusting the height of the extendable aerial service wire mast.

1 Claim, 3 Drawing Sheets

EXTENDABLE AERIAL SERVICE WIRE MAST

TECHNICAL FIELD

The present invention relates generally to equipment and methods for providing telecommunications services and, more particularly, to an extendable aerial service wire mast for addressing aerial service wire clearance problems.

BACKGROUND

Service wires, such as electric supply lines and communication lines have long been used in aerial applications. Standards, such as the National Electrical Safety Code (NESC), have been adopted to ensure safety to operating personnel and the general public in the application of aerial service wires. For example, these standards subject the placement of aerial service wires to certain minimum clearances above ground in urban and rural areas.

Problems arise, however, where sufficient and safe clearance cannot be obtained by attaching aerial service wires directly to a building or structure. In the past, the problems of insufficient height or clearance for aerial service wires have been addressed in one of three ways. One way involved mounting a bracket on the power mast and attaching the aerial service wire to the bracket. NESC policies, however, have mandated that this option is no longer acceptable due to the possible dangers when using a power mast to attain sufficient height or clearance.

A second way to attain sufficient height or clearance involved attaching a "ramshorn" to a higher peak on the building or structure. In general, a ramshorn is an iron rod having one end inserted in an insulator (e.g., rubber, composition, or metal-clad glass) and the other end shaped like a ram's horn. The aerial service wire is secured to the insulator by threading it through the opposing "horns." Sometimes this peak is far away from the outside network interface, however, which results in extra work for the technician who must run the aerial service wire from the peak around the eaves to the location of the outside network interface. This solution also requires the use of more materials (e.g., wire, drive rings, clamps). For aesthetic reasons, this solution caused customer dissatisfaction because wires from the house were not uniform due to the power drop being attached at one place on the house and telephone and television cable being attached at another.

A third way to attain sufficient height involved setting a new telephone pole between the house and the serving terminal. This engineering job was and is very costly to the responsible company or customer.

Accordingly, there exits the need for equipment and methods to provide sufficient and safe clearance for aerial service wires while avoiding possible dangers and/or expenses.

SUMMARY

In one general aspect, an apparatus for supporting an aerial service wire includes a mast capable of attachment to an aerial service wire. The mast may be extendable between at least a first position and a second position and connected to a clamp capable of attachment to a support structure.

Implementations may include one or more of the following features. For example, the mast may include first and second telescoping portions, such as interlocking pipes, constructed from metal and/or plastic. The telescoping portions may include one or more holes. At least one hole may be used for attachment to an aerial service wire. One or more holes of the first telescoping portion may be aligned with one or more holes of the second telescoping portion. A locking member such as a bolt, a screw, a rod or a pin may be used to lock the first and second telescoping portions in the second position.

The clamp may include a bracket and/or telescoping side plates. The aerial service wire may include a service drop and/or an attachment member, such as a ramshorn. The support structure may be a building and/or include an interface for the aerial service wire.

In another general aspect, a method for supporting an aerial service wire includes attaching an extendable aerial service wire mast to a support structure, attaching an aerial wire to the extendable aerial service wire mast, and adjusting the height of the extendable aerial service wire mast.

Other features and advantages will be apparent from the following description, including the drawings, and from the claims.

DETAILED DESCRIPTION

In one aspect, an extendable aerial service wire mast provides extra height needed to gain proper clearance for aerial service wires on most buildings and structures. This avoids the need for pole placements and the unacceptable and dangerous practice of attaching aerial service wires to a power mast.

Figure 1:
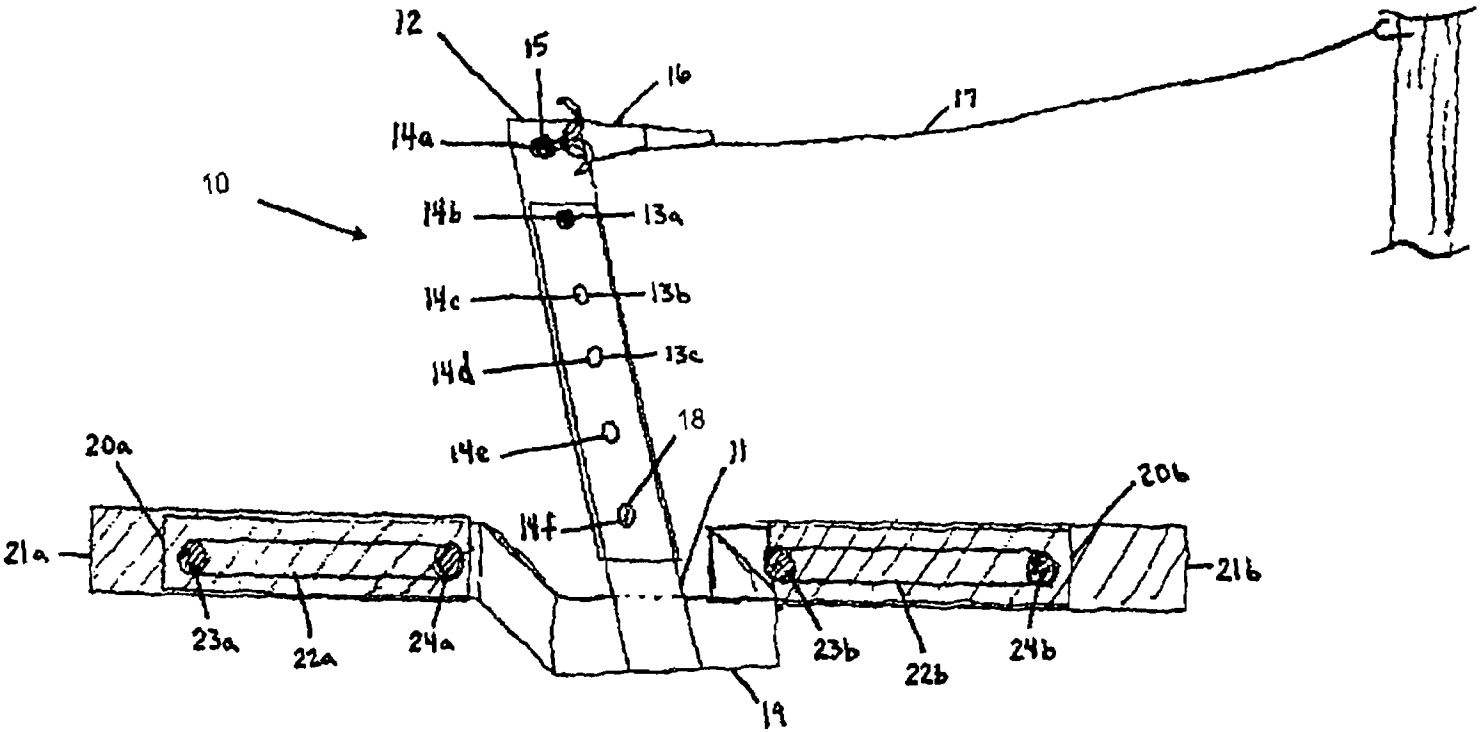
FIG. 1 illustrates one embodiment of an extendable aerial service wire mast according to the present invention.

FIG. 1 illustrates one embodiment of an extendable aerial service wire mast 10. As shown, the extendable aerial service wire mast 10 includes a first (inner) pipe 11 and a second (outer) pipe 12. The inner pipe 11 and the outer pipe 12 may be constructed of galvanized steel pipe, for example. In other embodiments, different material such as corrugated plastic may be used.

In one implementation, the inner pipe 11 and the outer pipe 12 of the extendable aerial service wire mast 10 are in interlocking engagement. That is, the inner pipe 11 fits within the outer pipe 12 for telescoping effect. In other embodiments, however, the telescoping effect could be achieved by using a first (outer) pipe and a second (inner) pipe.

While the dimensions may vary depending upon the particular implementation, in one embodiment, the inner pipe 11 may have a length of approximately eighteen inches and a diameter of approximately two inches. The outer pipe 12 may have a length of approximately sixteen inches and a diameter marginally greater than the diameter of the inner pipe 11.

Figure 2:
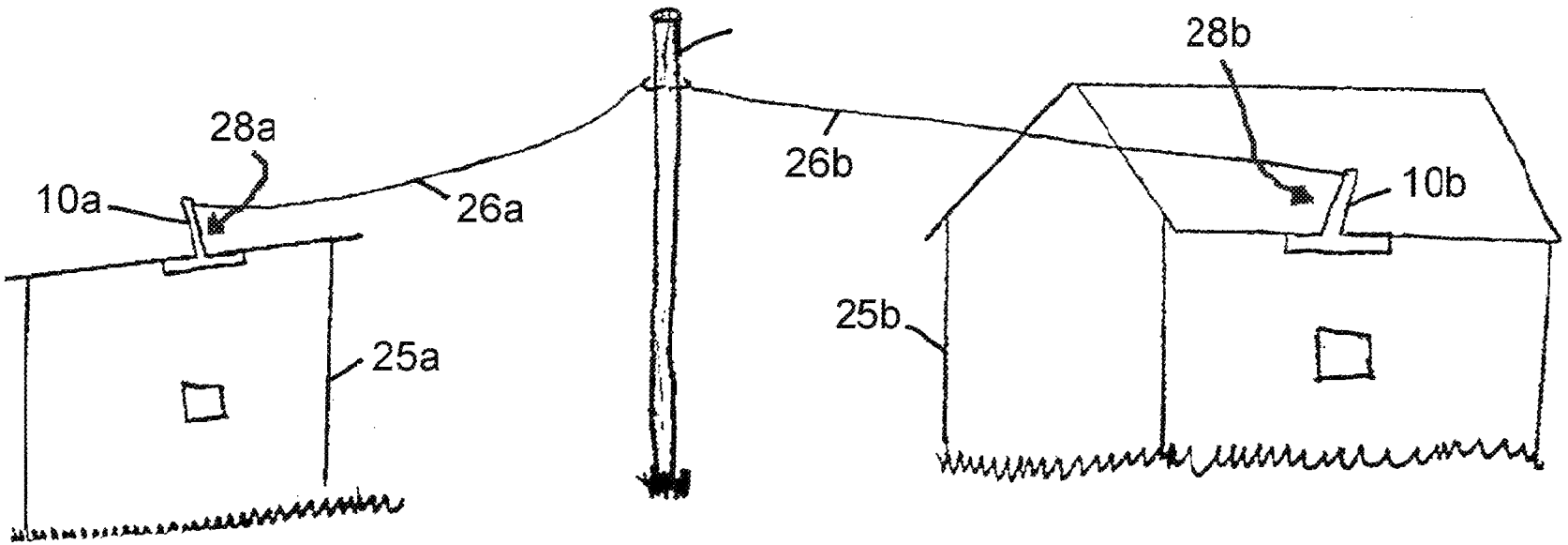
FIG. 2 illustrates the use of a plurality of extendable aerial service wire masts according to the present invention.

In general, the height of the extendable aerial service wire mast 10 may be adjustable to give aerial service wires needed height and/or clearance (see 28*a*, 28*b* in FIG. 2). In one embodiment, the height of the extendable aerial service wire mast 10 may be adjusted to approximately three feet. As shown, the inner pipe 11 may include a plurality of prefabricated threaded holes 13*a*-13*c* for accommodating different adjustable heights. In the embodiment of FIG. 1, the inner pipe 11 includes three holes 13*a*-13*c*, with the uppermost hole 13*a* being located approximately 1.5 inches below the top.

As mentioned above, the inner pipe 11 and the outer pipe 12 of the extendable aerial service wire mast 10 are in interlocking telescoping engagement. As shown in FIG. 1, the inner pipe 11 fits snugly within the outer pipe 12, and the top of the outer pipe 12 extends beyond the top of the inner pipe 11. The height of the extendable aerial service wire mast 10 may be adjusted, for example, by sliding the outer pipe 12 upward and connecting the inner pipe 11 and the outer pipe 12.

In one embodiment, the outer pipe 12 includes a plurality of prefabricated threaded holes 14*a*-14*f*. In this embodiment, the outer pipe includes six holes. A first locking member 15 may be positioned through the uppermost hole 14*a* of the outer pipe 12 to secure an attachment member 16 (e.g., ramshorn) to the outer pipe 12. The attachment member 16, in turn, may be connected to an aerial service wire 17. The locking member 15 may be any type of device configured to secure the attachment member 16 to the outer pipe 12. In general, the type of locking member 15 that is used may depend on the particular implementation. Examples include, but are not limited to a threaded bolt and nut, a screw, a rod, and a pin.

A second locking member 18 may be used to connect the inner pipe 11 to the outer pipe 12 when adjusting the height of the extendable aerial service wire mast 10. For example, by positioned the second locking member 18 through hole 14*f* of the outer pipe 12 and through hole 13*a* of the inner pipe 11, the maximum height of the extendable aerial service wire mast 10 is achieved. In general, however, the locking member 18 may be positioned through any one of holes 14*b*-14*f* of the outer pipe 12 and any one of holes 13*a*-13*c* to adjust the height of the extendable aerial service wire mast 10. The size and spacing of the holes 13*a-c* and holes 14*b*-14*f* may be substantially similar so as to allow for easy alignment. The locking member 18 may be any type of device (e.g., threaded bolt and nut, a screw, a rod, a pin, etc.) configured to secure the inner pipe 11 to the outer pipe 12.

As shown in FIG. 1, the extendable aerial service wire mast 10 also may include a clamp for securing the extendable aerial service wire mast 10 to a building or other structure. The clamp may be used, for example, to secure the extendable aerial service wire mast 10 to a house at a point where the fascia and the soffit meet. In one embodiment, the clamp includes a generally U-shaped bracket 19, a first (left) inner side plate 20*a*, a first (left) outer side plate 21*a*, a second (right) inner side plate 20*b*, and a second (right) outer side plate 21*b*.

In one implementation, the inner side plates 20*a*, 20*b* and corresponding outer side plates 21*a*, 21*b* may provide telescopic effect. The inner side plates 20*a*, 20*b* each may include a respective slot 22*a*, 22*b* for limiting the amount of extension. In one embodiment, the extension may be from approximately eighteen to thirty-five inches. The left outer side plate 21*a* may include holes 23*a*, 24*a* (e.g. predrilled screw holes) for receiving screws to attach the left inner side plate 20*a* and the left outer side plate 21*a* to a building or other structure. Similarly, the right outer side plate 21*b* may include holes 23*b*, 24*b* (e.g., predrilled screw holes) for receiving screws to attach the right inner side plate 20*b* and the right outer side plate 21*b* to a building or other structure.

As shown in FIG. 1, the inner pipe 11 may be angled relative to one of the inner side plates for added stability. In one embodiment, the inner pipe 11 may be angled at approximately 70° relative to the left inner side plate 20*a*. The extendable aerial service wire mast 10 may further include a stabilizing strap (not shown) when the mast is in the extended position to provide further stability.

FIG. 2 illustrates use of a plurality of extendable aerial service wire masts according to one embodiment of the present invention. As shown, a first extendable aerial service wire mast 10*a* is attached to a first house 25*a* and a second extendable aerial service wire mast 10*b* is attached to a second house 25*b*. In one implementation, the first extendable aerial service wire mast 10*a* may connect to a first service drop 26*a* running from a utility pole 27 with clearance 28*a*. The second extendable aerial service wire mast 10*b* may connect to a second service drop 26*b* running from the utility pole 27 with clearance 28*b*. In general, a service drop includes one or more service lines e.g., wires, cables that run from a utility distribution point e.g., distribution transformer, distribution cable on a utility pole e.g., electric pole, telephone pole to a service entry point of a household or building.

Figure 3:
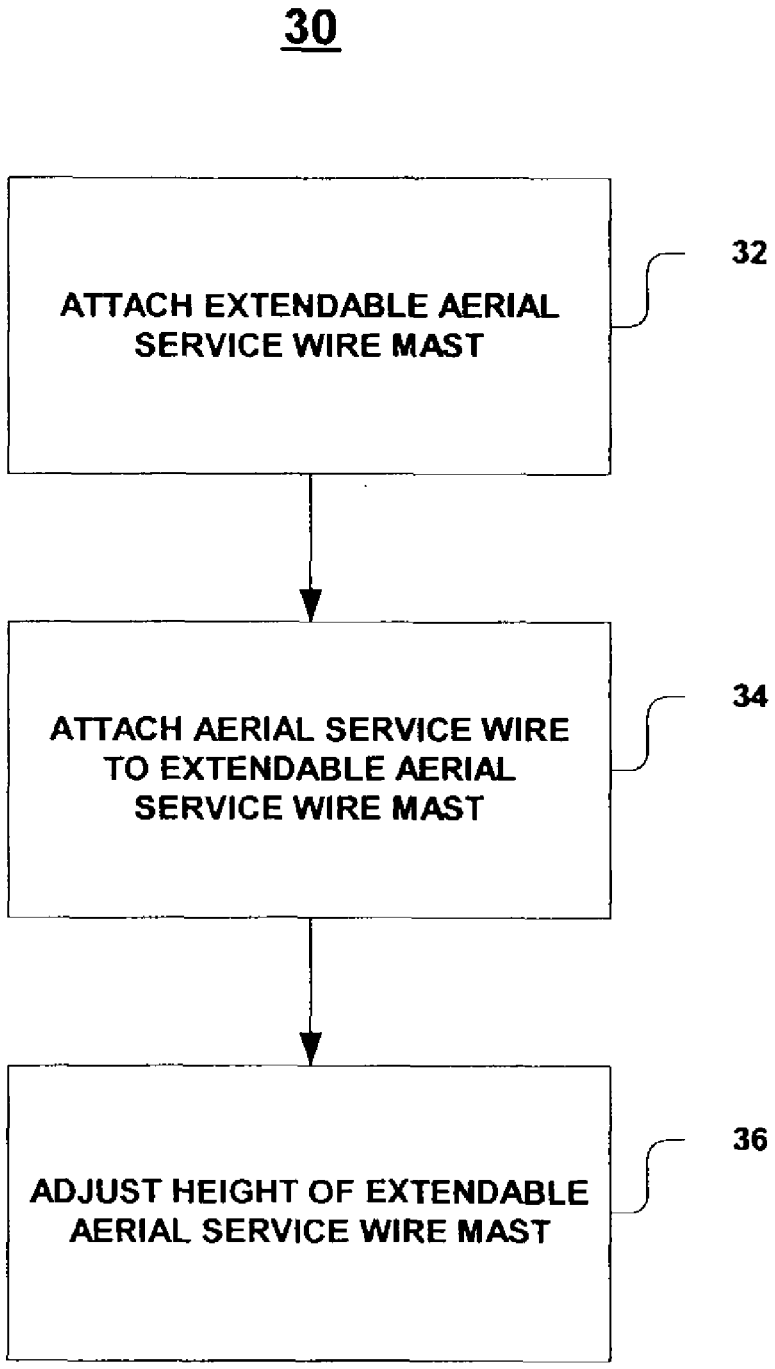
FIG. 3 is a flowchart of one embodiment of a method for supporting an aerial service wire according to the present invention.

FIG. 3 illustrates a flow chart for one embodiment of a method 30 for supporting an aerial service wire. In general, supporting an aerial service wire with an extendable aerial service wire mast will provide the extra height needed to gain proper clearance for the aerial service wire on most buildings and structures. This avoids the need for pole placements and the unacceptable and dangerous practice of attaching the aerial service wire to a power mast.

At step 32, a technician attaches the extendable aerial service wire mast to a building or other structure. In one implementation, the extendable aerial service wire is attached using a clamp. For example, the clamp may be used to secure the extendable aerial service wire mast to a house at a point where the fascia and the soffit meet. In some cases, attaching the extendable aerial service wire mast may include adjusting the side plates of the clamp and using screws to secure the side plates to the building or structure.

At step 34, the technician attaches an aerial service wire to the extendable aerial service wire mast. In general, the aerial service wire may include an attachment member such as a ramshorn. In one implementation, the extendable aerial service wire mast may include a pipe having a prefabricated hole. A locking member such as a threaded bolt and nut, a screw, a rod, or a pin may be positioned through the hole of the pipe to secure the attachment member.

At step 36, the technician adjusts the height of the extendable aerial service wire mast. In general, the height of the extendable aerial service wire mast may be adjusted to provide safe and sufficient clearance. In one implementation, the extendable aerial service wire mast may include first and second pipes that are interlocking and in telescoping engagement. Adjusting the height of the extendable aerial service wire mast may include sliding one of the pipes upward and connecting the two pipes together. The pipes each may include prefabricated holes and may be connected together using a locking member such as a threaded bolt and nut, a screw, a rod, or a pin.

When attached to an aerial service wire and a building, the aerial service wire mast provides safe and sufficient clearance for service drops. Accordingly, the extendable aerial service wire mast may be used to address problems where sufficient and safe clearance cannot be obtained by attaching the wire directly to the building or structure at the nearest point where the outside network interface is placed. Technicians also would avoid possible danger and/or expenses that might be incurred by using the power mast in order for the aerial service wire to attain sufficient height or clearance.

As described and illustrated, aspects of the present invention provide an improvement over past and current equipment and methods. Namely, the extendable wire service mast may provide the extra height needed to gain proper clearance for aerial service wires on most buildings and structures while avoiding the need for pole placements and the unacceptable and dangerous practice of attaching aerial service wires to a power mast.

A number of implementations have been described. Nevertheless, it will be understood that various modifications may be made and that other implementations are within the scope of the following claims. For example, the extendable aerial service wire mast may be used by other utilities such as, for example, television cable companies that have a similar need to attach service drops to buildings with safe and sufficient clearance.

What is claimed is:

1. An apparatus comprising:

an aerial service wire extending between a service distribution point and a building, the aerial service wire including a telecommunication service drop from a service distribution point;

extending means for extending a height of the aerial service wire above the building between at least a first position and a second position; and a clamp connected to the extending means for extending the height of the aerial service wire, the clamp also secured to the building, the clamp comprising a generally "U"-shaped center portion to which the extending means is secured, the clamp also comprising a left bracket connected to a distal end of a left arm of the generally "U"-shaped center portion and a right bracket connected to a distal end of a right arm of the generally "U"-shaped center portion, the left arm of the generally "U"-shaped center portion outwardly extending from the left bracket and the right arm of the generally "U"-shaped center portion outwardly extending from the right bracket, such that when the left bracket and the right bracket are horizontally attached to the building, the generally "U"-shaped center portion outwardly extends from the building and displaces the mast from the building;

the left bracket comprising a left inner side plate sliding along a left outer side plate such that the left bracket is extendable in length, the left outer side plate including two left-side screw holes through which two screws respectively attach the left outer side plate to the structure, the left inner side plate including a single left-side longitudinal slot therein through which the two screws pass, thus limiting an extension of the left bracket to a length of the left-side longitudinal slot the right bracket comprising a right inner side plate sliding along a right outer side plate such that the right bracket is extendable in length, the right outer side plate including two right-side screw holes through which two screws respectively attach the right outer side plate to the structure, the right inner side plate including a right-side longitudinal slot therein through which the two screws pass, thus limiting an extension of the right bracket to a length of the right-side longitudinal slot; and the extending means connected to the generally "U"-shaped center portion at a seventy degrees (70°) angle relative to the left inner side plate, wherein the extending means is connected to the aerial service wire and is extensible in length to adjust a clearance of the aerial service wire above the building.

* * * * *